United States Patent [19]

Pauli

[11] 4,250,819

[45] Feb. 17, 1981

[54] STEP GRATE

[76] Inventor: Balduin L. Pauli, Bergstrasse 34, D-8035 Gauting vor München, Fed. Rep. of Germany

[21] Appl. No.: 938,080

[22] Filed: Aug. 30, 1978

[30] Foreign Application Priority Data

Oct. 4, 1977 [DE] Fed. Rep. of Germany ..... 2744505

[51] Int. Cl.[3] ..... F23B 1/22

[52] U.S. Cl. ..... 110/281; 414/194

[58] Field of Search ..... 110/281, 282, 328; 126/174; 198/750, 773, 777; 214/18.34, 23, 18.36

[56] References Cited

U.S. PATENT DOCUMENTS

| | | | |
|---|---|---|---|
| 2,428,874 | 10/1947 | Gough | 110/284 |
| 4,103,627 | 8/1978 | Mainka | 110/281 |

*Primary Examiner*—Edward G. Favors

*Attorney, Agent, or Firm*—Balogh, Osann, Kramer, Dvorak, Genova & Traub

[57] ABSTRACT

A step grate including feeding means, distributor, step grate elements and combustion grate, comprising a stationary flat grate on which the distributor acts, and at least one further flat grate associated therewith on which a further distributor acts, in each case with combustion air supply, this being followed by the combustion grate, and the stationary flat grate steps may be followed by pivot grate bars, said stationary flat grates being divided in two and downwardly up to 80% completely sealed.

11 Claims, 5 Drawing Figures

STEP GRATE

The present invention relates to a step grate with feeding means, distributor, step grate elements and combustion element.

Such step grates are preferably used for the joint burning of sludge and wet sewage sludge, the sludge being discharged onto the refuse. According to one known construction at the bottom of a refuse feed hopper double shut-off flap valves are provided onto which the sludge is discharged.

On the other hand step grates are known as step pivot grates which consist of two elements, a flat grate and an inclined grate, the inclined grate being supported on the flat grate. Lifting means lift the flat grates at predetermined intervals of time and with them the inclined grates, the material disposed thereon thus being conveyed to the next grate step.

Difficulties are encountered firstly because at the points of greatest liberation of heat the refractory masonry is eroded because the side walls at these locations are subjected to the greatest thermal stresses.

Secondly, on the introduction of materials which become thinly liquid in the burning phase, pasty materials or plastics, it was inevitable that these materials partially trickled through the grate and partially reached the next step too rapidly.

These problems are solved in surprisingly simple manner according to the invention by a stationary flat grate on which the distributor acts, and at least one further flat grate associated therewith on which a further distributor acts, in each case with combustion air supply, this being followed by the combustion grate.

Preferably, the stationary flat grate steps are followed by pivot grates.

The stationary flat grates are expediently divided in two and downwardly, the bottom side thereof being at least 80% completely closed.

It is favourable for the stationary flat grates to be solidly supported at least in their larger area at the rear seen from the combustion chamber.

When the step grate continues with pivot grates the pivot grate elements may consist of a single grate bar element articulately mounted on the combustion chamber side, said element preferably extending upwardly by 5 to 15 degrees at its end remote from the articulate mounting.

A substantial distance may be provided vertically between two grate bar elements.

The upwardly extended end of the grate bar element is associated with a stationary substantially perpendicular air-cooled fireclay cover plate arcuately adapted to the grate bar movement or with a perpendicular grate.

It is of particular advantage when the perpendicular stationary grate for the air passage is divided and rearwardly curved and consists of Sicromal steel plate with monolithic lining material.

Alternatively, following the grate portion which operates with a single moveable upwardly bent grate bar element, step pivot grate elements may be arranged.

In a further development of the invention in the region of the greatest heat liberation air may be blown in perpendicularly to the grate movement from the side masonry.

According to a preferred embodiment for this purpose air cooling beams are provided in the side walls of the combustion chamber.

The air cooling beams may be constructed as web and the air supply and removal conduits as leg of a "U". It is expedient to supply exit nozzles for the air in the lower portion of the web, the remaining portion of this surface on the combustion chamber side being provided with refractory pins and refractory material, and in the region of the nozzles and pins cooling ribs projecting into the cooling beam are provided.

The nozzles disposed a distance above the grate upper edge may be directed upwardly, preferably at 45 degrees. The steps of the invention provide an improved combustion of the thin liquid pasty materials, or materials softening under heat, because due to the substantially closed (80%) of the bottom side of the fixed grate at elevated temperature these materials have a greater residence time on the flat grates, of which a plurality may be connected in series depending on the requirements. The division of the stationary grates, including the feed grate, into two parts also considerably improves the air supply. The feed grate is cooled in the front region by air supply.

The combustion material is transported by means of the distributors.

The moveable pivot grates possibly disposed following the fixed and sealed flat grates consist of only a single moveable grate element of about 1 to 1.20 m length which may be fundamentally constructed like the horizontal grate bar of a step pivot grate element. However, in the last third or quarter this grate bar is bent upwardly at an inclination of 5 to 15 degrees at the side remote from the combustion chamber. The intermediate wall between the grate element disposed thereabove and the moveable pivot grate may be made in the form of air-cooled fireclay plates or in the form of curved Sicromal bars similar to a grate bar. This rear wall replacing the inclined grate is cooled with fresh air via grate gaps or openings in the fireclay plates.

As a result of the steps according to the invention the pasty, tacky or thinly liquid materials are completely burnt on the stationary grates before they reach the moveable pivot grate.

Thus, the air cooling on both sides of the grate not only prevents eroding of the masonry; in addition, air is supplied in horse-shoe fashion, i.e. from all sides, to the material together with the upper air so that breakage of the masonry is improbable, especially since the stationary fireclay plates are divided and thus cooled by the combustion air. On the other hand, the intention of cooling the lined divided Sicromal beam by air which is then simultaneously preheated as combustion air at the point in which combustion is to take place in the chamber is achieved.

Some examples of embodiment of the invention will be explained with reference to the attached drawings, wherein.

Figure 1:
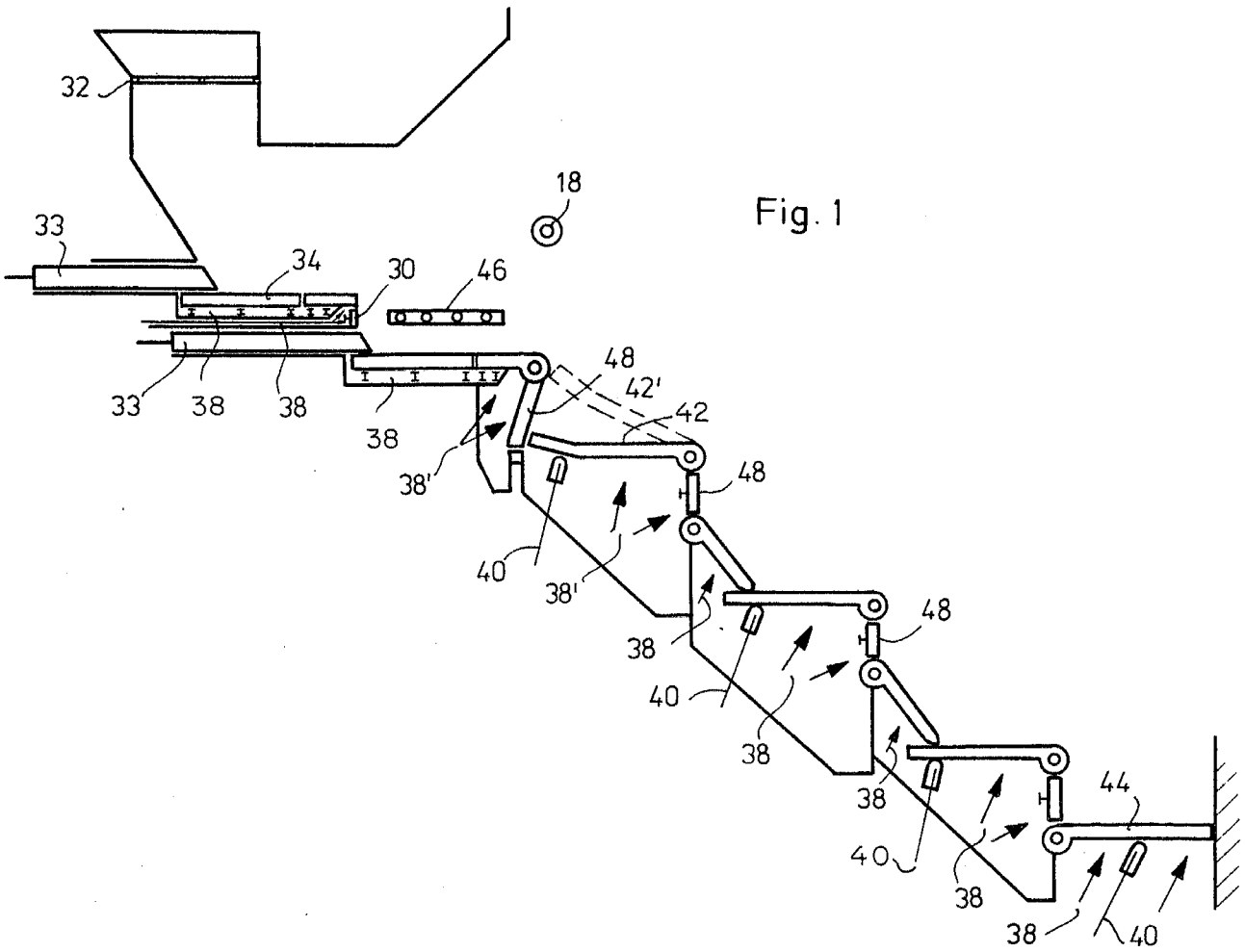
FIG. 1 shows a first embodiment according to the invention.
Figure 2:
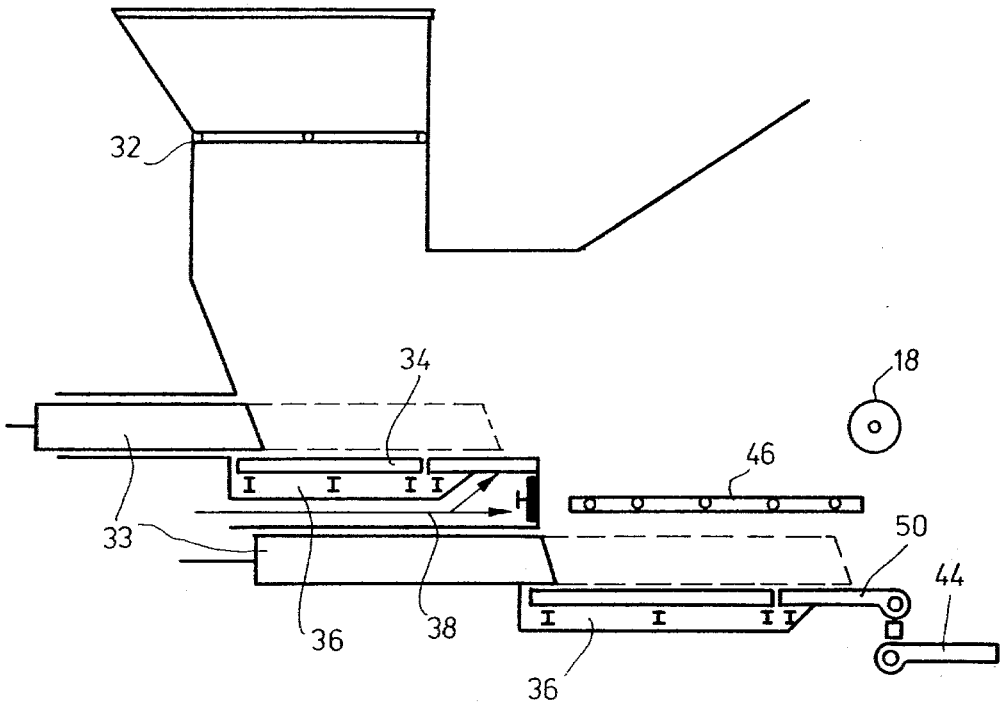
FIG. 2 shows a simplified embodiment.

The embodiment of FIG. 1 comprises a step grate with flat grates, moveable pivot grates, step pivot grates and combustion grates. Beneath the feeding means or double flap 32 the material passes into the combustion chamber and in the latter onto a stationary grate 34 which is divided into two parts and which over 80% of the length of the bottom side thereof consists of closed fixed supports and is downwardly closed completely up to 80%. The air distributing means for combustion air which are conventional (for example, air conduits) and are designated in each case by 38 (shown also as arrows in FIG. 1) and the air thus passes between the lower distributor still to be described and the air distributing means 38 and then flows round the stationary grate part 30 made up of fireclay plates or Sicromal sheet with pins, lined on the inside, of 20×30 cm dimensions, with mounting on cross webs and a cooled bar mounting in the masonry. To compensate the expansion due to heat and for improved cooling the feed grate is divided. The feed grate is followed by a similarly constructed flat grate which, because substantially identical need not be separately described. The distributor 33 or pusher element is rather conventional. The main function of the upper distributor 33 is to transport, push or feed the partially burned sludge materials from the two-part feed grate onto the two-part combustion grate. The lower distributor 33 serves to push or transport sludge material from the two-part combustion grate into the first pivoted step grate or directly to combustion grate 44 as shown in the embodiment of FIG. 2.

To hold back bulky materials, above the two-part combustion grate an air-cooled pressure tube 18 is disposed and this prevents bulky materials such as automobile tires, cable drums and the like simply rolling down over the grates and causing damage to the masonry.

The pressure tube 18 is lined with a highly refractory monolithic material and is cooled on the inside with air.

Disposed laterally of the grates are air boxes 46 with distributor nozzles which in this Figure are indicated only and will be described in more detail hereinafter.

At 48 a stationary grate portion 48 replacing the inclined grate in a step pivot grate is provided and is rearwardly inclined and may possibly also be slightly arcuately formed so as to ensure always the same distance from the end of the grate bar element of the pivot grate 42. This standing grate may again be formed from fireclay plates or Sicromal bars, as mentioned above, and in a manner known for such grates the pivot grate 42 may be raised by conventional lifting means as entire element into an upper position of 27 to 32 degrees. As can be seen, the rear end on the lifting means side is bent upwardly through 5 to 15 degrees. This prevents the material to be burned from falling rearwardly. The grate bar has a depth of 100 to 120 cm. The lifting means 40 (which may be a conventional hydrolically operated lifting cylinder or any lifting device) may also execute a small stirring motion in the pivotable bar or grate by poking and transporting. As indicated at 38' the air cooling is along the stationary plates and flows round the combustion-chamber-side edges of the grate bar element and of the stationary grate.

In the illustration two steps follow with step pivot grates which need not be explained in detail because they are known per se. However, in this case the step pivot grates are not disposed over each other but arranged separated by the fixed vertical grate. The lifting means 40 ensure a stirring and feed movement of the step pivot grate. Beneath the last step pivot grate there is once again perpendicular stationary masonry flushed by air. It is followed by the combustion grate 44, known per se, with air cooling and distributing means 38, which may be tilted from time to time by a lifting means.

A modification illustrated in FIG. 2 shows that it is alternatively possible to burn in particular thinly liquid or pasty materials on fixed stationary grates. The same reference numerals denote corresponding elements. The distributor 33 feeds the partially burned for example pasty materials from the two-part feed grate 34 onto the two-part combustion grate 50. Combustion air is blown for example onto this grate 50 from all sides, from air distributing means 38 and the air cooling means 46, air flows from above the grates in a particular horseshoe form from the air cooling beams 46, described hereinafter. 18 again denotes the pressure tube retaining the bulky materials. From the fixed combustion grate 50, which is air cooled on the combustion chamber side, the material drops through the height of the upright wall element (not shown) onto the combustion grate 44.

Figure 3:
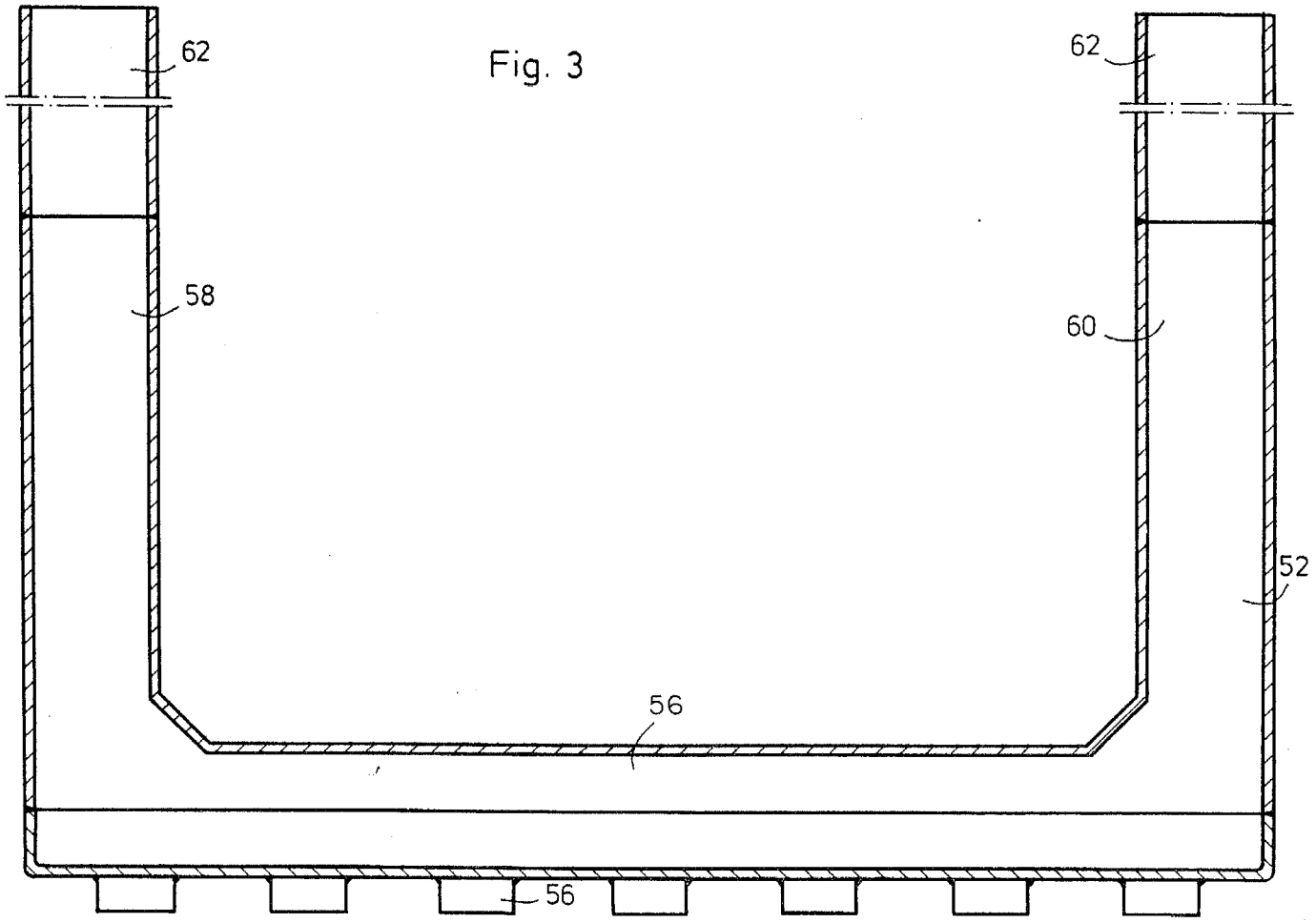
FIG. 3 shows a detail in horizontal section.
Figure 4:
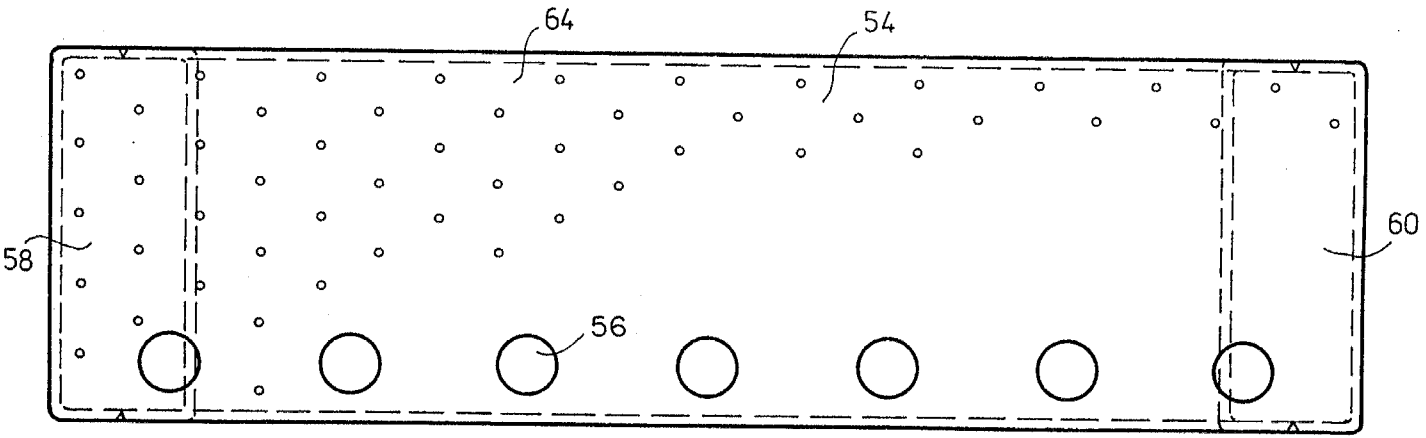
FIG. 4 shows a detail in vertical section.
Figure 5:
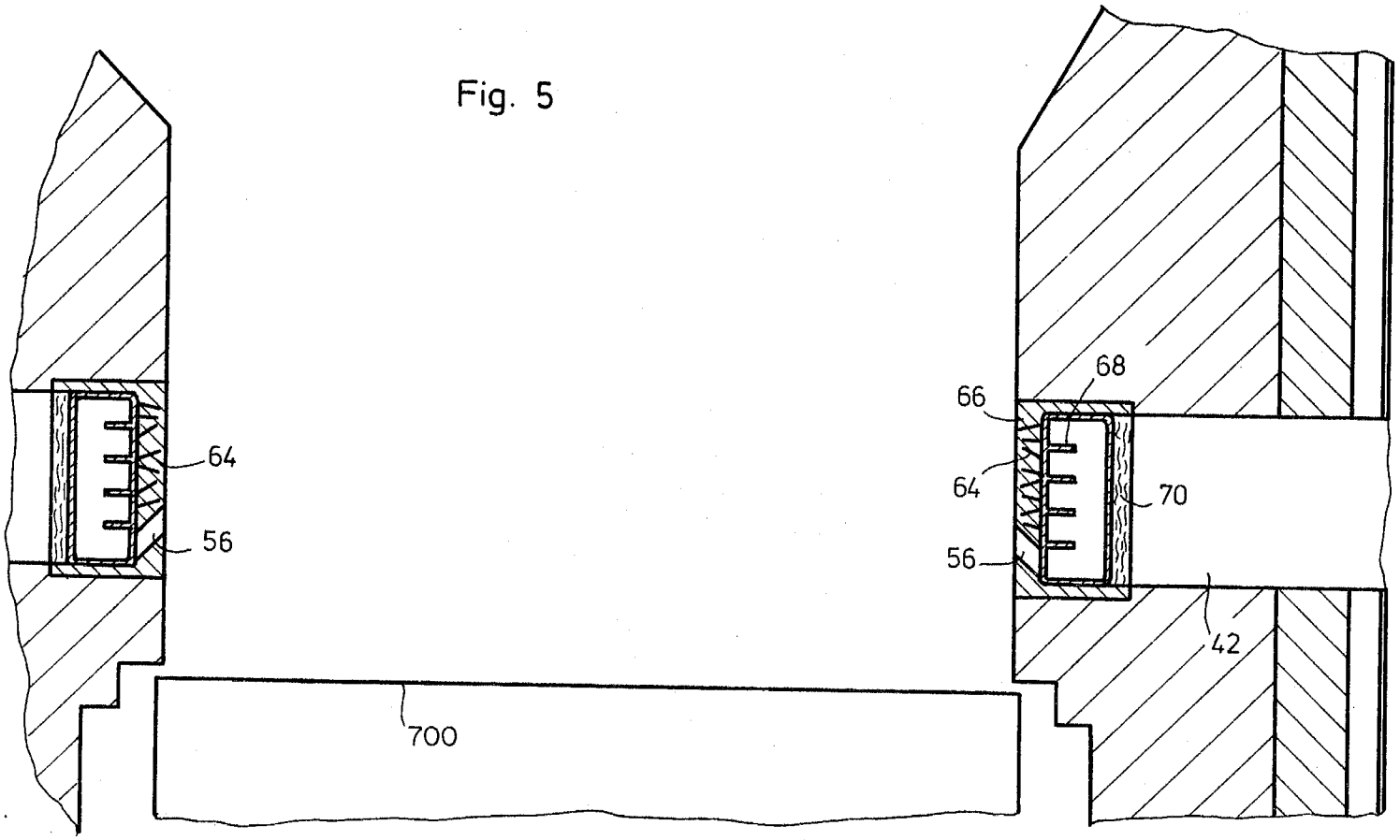
FIG. 5 shows an arrangement detail.

FIGS. 3 to 5 show the construction of the air-cooling beam in the firing. At least two air-cooling beams are provided which are designated generally with 52 and as apparent from FIG. 5 are disposed on both sides of the grate (grate 700 in FIG. 5) in the side masonry of the combustion chamber. The air-cooling beam has in horizontal section the form of a "U", the leg 54 carrying the air nozzles 56 and cooling air being supplied by the legs 58 and 60. By fans which are not illustrated the legs 58 and 60 are supplied by sheet metal channels 62. These sheet metal channels consist for example of St.37 and are welded to the legs 58 and 60. In the region of the legs 60 and 58 the air is heated before being blown out. Air at ambient temperature would subject the masonry or the grate to be cooled to excessive thermal stresses. As apparent from FIG. 4 the nozzles 56 are provided at equal intervals in the lower portion of the web provided with pins 64 and monolithic lining material. The pins 64 consist of Sicromal and are welded on offset in inclined manner. The web portion itself is best made from cast iron. On one side of the grate a plurality of air-cooling beams may be provided adjacent each other and the legs subjected to air from a fan. As apparent from FIG. 5 the nozzles 56 are arranged inclined upwardly and disposed in the monolithic lining material 66. Cooling ribs 68 protect the air-cooling beam from excessive heating. The air-cooling beam is moreover insulated at 70 on the side remote from the combustion chamber. The monolithic lining material is provided both above and beneath the air box as apparent from FIG. 5.

The air cooling also of course serves for improved combustion.

The air distributing nozzles thus provide the distributor with air from the front and from above.

What we claim is:

1. In a step grate for combustion of sludge material, including feeding means, a plurality of step grate elements, comprising a vertical stationary element and a horizontal pivotable element, a distributor associated with said feeding means for transporting partially burned combustion material to a first step grate element, a combustion grate following the last of said step grate elements, and means for lifting and stirring said horizontal pivotable element so as to feed the combustion materials to the next step grate element, the improvement which comprises a first stationary flat grate disposed beneath the distributor, a further distributor disposed beneath said first stationary grate, and a second stationary flat grate disposed beneath said further distributor, each of said first and second stationary flat grates being divided into two parts to compensate for heat expansion thereof, and over 80% of the bottom side of each of said first and second stationary flat grates being completely closed, the distributor transporting combustion material from said first stationary flat grate to said second stationary flat grate, and said further distributor transporting combustion material from said second stationary flat grate to said first step grate element.

2. An improved step grate as set forth in claim 1, wherein said first and second stationary flat grates are solidly supported, at least over the larger part of their bottom side.

3. An improved step grate as set forth in claim 1, wherein said pivotable horizontal element extends upwardly by 5 to 15 degrees at its end remote from its pivoted end.

4. An improved step grate as set forth in claim 1, wherein said step grate elements are arranged in a vertical spaced relationship and said vertical stationary element separates therebetween, said stationary element being substantially perpendicular to a respective step grate element, and constituting an air cooled fire clay cover plate.

5. An improved step grate as set forth in claim 4, wherein said vertical stationary element is rearwardly curved and consists of sicromal steel plates with monolithic material lining.

6. An improved step grate as set forth in claim 4, wherein said pivotable horizontal element is separated from said vertical stationary element by a vertical pivotable element resting with its lower end on said horizontal pivotable element, the upper pivotable end of said vertical pivotable element cooperating with said vertical stationary element.

7. An improved step grate as set forth in claim 1, further comprising air cooling beams disposed in the side walls of the combustion chamber, and air being blown in a direction perpendicular to the grate's movement in a predetermined region of the grate where the greatest amount of heat is generated.

8. An improved step grate as set forth in claim 7, wherein each of the air cooling beams has in horizontal section, the form of a "U", the legs of the "U" being air supplies.

9. An improved step grate as set forth in claim 7, wherein each of the air cooling beams is constructed as a web, and includes exit nozzles for the air in the lower portion of the web, the remaining portion of the web being provided with high resistant pins and refractory monolithic lining material, and wherein cooling ribs projecting into the cooling beams are disposed in the region of the nozzles and pins.

10. An improved step grate as set forth in claim 9, wherein said nozzles are disposed somewhat above the upper edge of the grate, said nozzles being inclined upwardly at 45 degrees.

11. An improved step grate as set forth in claim 7, wherein a plurality of cooling beams is disposed adjacent each other and provided with a single air supply.

* * * * *